United States Patent [19]

Saucy

[11] Patent Number: 4,613,066

[45] Date of Patent: Sep. 23, 1986

[54] GARMENT DRYING FORM COMPRISING FLEXIBLE, CONFORMABLE MESH INSERT BODY

[76] Inventor: Jeannette E. Saucy, 2603 Barrett Ave., Richmond, Calif. 94804

[21] Appl. No.: 848,834

[22] Filed: Apr. 2, 1986

Related U.S. Application Data

[63] Continuation of Ser. No. 212,823, Dec. 4, 1980, abandoned.

[51] Int. Cl.[4] ..... A47G 25/20

[52] U.S. Cl. ..... 223/66; 223/85; 34/103

[58] Field of Search ..... 223/66, 67, 68, 69, 223/70, 85, 98; 34/21, 103, 104; 8/150

[56] References Cited

U.S. PATENT DOCUMENTS

| | | | |
|---|---|---|---|
| 2,256,043 | 9/1941 | Cohen | 223/68 |
| 2,439,078 | 4/1948 | Coney | 223/69 |
| 2,484,806 | 10/1949 | Larson et al. | 223/69 |
| 2,511,796 | 6/1950 | Fitpold | 223/70 X |
| 2,539,895 | 1/1951 | Cuneo et al. | 223/69 |
| 2,679,956 | 6/1954 | Richterkessing | 223/70 |
| 2,719,656 | 10/1955 | Cromartie | 223/68 |
| 2,828,899 | 4/1958 | Zuckerman | 223/98 |
| 2,880,917 | 4/1959 | Pancari | 223/68 |
| 2,889,970 | 6/1959 | Wallis | 223/68 |
| 3,003,248 | 10/1961 | Wittie . | |
| 3,040,903 | 6/1962 | Crews . | |
| 3,179,315 | 4/1965 | Sieradzki | 223/98 |
| 3,237,778 | 3/1966 | Hoodis . | |
| 3,286,889 | 11/1966 | Schlemon | 223/70 |
| 3,381,864 | 5/1968 | Shields . | |
| 3,396,881 | 8/1968 | Aloi | 223/67 |
| 3,486,669 | 12/1969 | George et al. | 223/69 |
| 3,501,847 | 3/1970 | Sanford et al. | 223/69 X |
| 3,602,408 | 8/1971 | Gaydos | 223/98 |
| 4,303,183 | 12/1981 | Schlemon | 223/70 |

*Primary Examiner*—Robert R. Mackey
*Attorney, Agent, or Firm*—David Pressman

[57] ABSTRACT

A garment drying device utilizes a foraminous container or bag and sleeves fabricated from a flexible, generally water repellent first foraminous or open mesh woven material, which container is adapted to fit inside the garment and to generally conform to the shape of the garment. Contained inside the foraminous container or bag is a generally resilient, water repellent second foraminous or open weave mesh material distibuted by ruffling and attaching it to the top of the bag and sleeves. If needed for reshaping the drying garment, additional mesh is inserted randomly in the bag. Velcro fasteners at the bottom of the bag keep additional mesh in place. The weight of the drying garment is rested on seamless mesh and foam rubber or plastic pads which are adhered inside the top of the bag to prevent seam and hanger marks from showing on the garment. The resilience of the second foraminous material is chosen to be sufficient to hold the sides of the container or bag apart and allow air to flow through the foramina or mesh in both the first and second foraminous materials. An adjustable frame can also be used to prevent shrinkage of highly shrinkable garments.

2 Claims, 4 Drawing Figures

10
12
14
16
18
20
22
23
24
30
32
34
40
42
44
46
48
50
52
54
60
62
2

GARMENT DRYING FORM COMPRISING FLEXIBLE, CONFORMABLE MESH INSERT BODY

CROSS-REFERENCE TO RELATED APPLICATION

This application is a continuation of application Ser. No. 06/212,823 filed Dec. 4, 1980, now abandoned.

BACKGROUND OF THE PRIOR ART

This invention relates generally to garment drying devices and in particular to garment drying devices which are adapted to maintain the approximate shape of the garment and be suspended in a vertical position.

The garment drying devices of the prior art typically comprise a rack or mesh of a foraminous material upon which the garment was laid, generally in a horizontal position, for drying.

Some of the prior art devices included clamps which were applied to the outside of the garment to prevent shrinking of the material.

Other devices utilized a framework defining the approximate shape of the garment and placed inside the garment to maintain its shape. The garment, however, remained flat, allowing the moisture to escape only from the exterior of the garment.

Still other devices were fabricated as a double, rigid wire grid between which the garment was clamped in order to hold its shape and to prevent it from sagging when the device was hung in the vertical position. Again, moisture was allowed to escape only from the exterior of the garment.

Such garment drying devices of the prior art all represented cumbersome and expensive methods of drying the garment by permitting the moisture to escape only from the exterior of the garment.

SUMMARY OF THE INVENTION

The garment drying device of the present invention comprises, basically, a container or bag fabricated from a flexible, water repellant first foraminous material adapted to fit into and to generally conform to the shape of the garment being dried, with a generally resilient, water repellent second foraminous material contained and disposed in a random manner inside the foraminous container or bag. A means for hanging the garment drying device in the vertical position is provided at one end of the device.

The weight of the drying garment is rested on foam rubber or foam plastic pads which are attached inside the top of the bag to prevent the hanging device from marking the garment.

An adjustable, generally rigid, framework can be employed within the foraminous container in order to hold the size or shape of a highly shrinkable garment.

OBJECTS AND ADVANTAGES

It is, therefore, an object of the present invention to provide a device for drying a garment.

It is a further object of the present invention to provide a garment drying device which is portable and compact.

It is another object of the present invention to provide a garment drying device utilizing a flexible foraminous material disposed inside the garment.

It is still another object of the present invention to provide a garment drying device which allows air to circulate both inside and outside the garment.

It is yet another object of the present invention to provide a garment drying device which allows air to circulate through the garment while in the vertical position.

These and other objects of the present invention will become manifest upon careful study of the following detailed description when taken together with the drawings.

DESCRIPTION OF THE PREFERRED EMBODIMENT

Figures 1, 2, 3, 4:
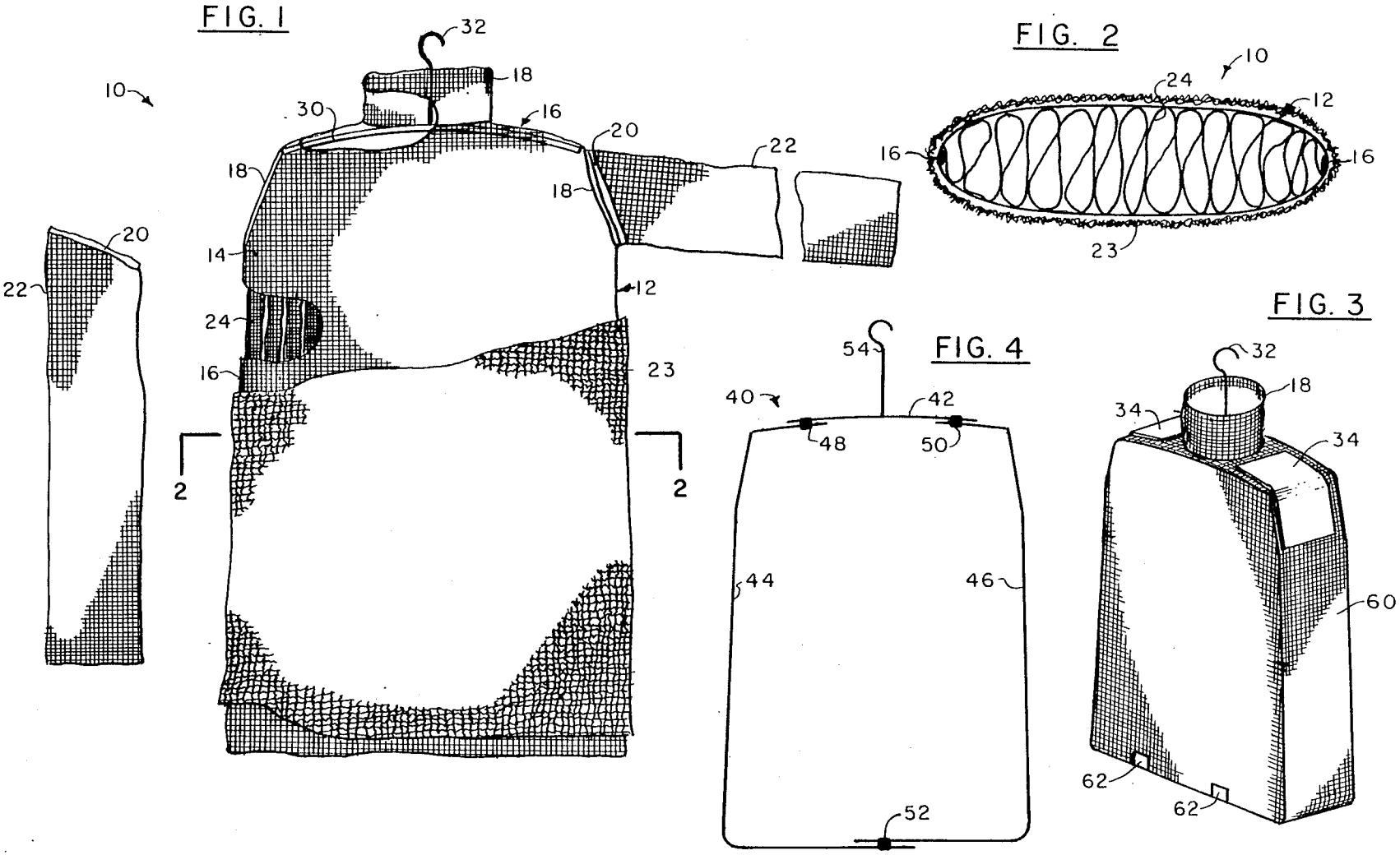
FIG. 1 is a front elevational view of the garment drying device of the present invention shown, typically, for a sweater.
FIG. 2 is a cross-sectional view of the garment drying device of FIG. 1 taken at lines 2—2.
FIG. 3 is an isometric view of the garment drying device of FIGS. 1 and 2 showing the use of foam plastic shoulder pads to prevent seam and hanger marks from showing on the garment.
FIG. 4 is a front elevational view of an adjustable, generally rigid, frame for use with the garment drying device of FIG. 1 for a shrinkable garment.

FIG. 1 shows a front elevational view of a typical garment drying device 10 of the present invention adapted to dry a sweater.

The sweater drying device 10 of FIG. 1 comprises, basically, a main body member 12 defining a foraminous container fabricated from a generally flexible water repellent, first foraminous material 14 held together along its sides by a seam 16. A neck portion 18 is attached proximate the upper portion of body member 12. An arm seam section 18 is adapted to receive or abut against a like arm seam 20 of arm member 22.

Both body member 12 and arm members 22 define containers adapted to fit inside of a garment or sweater 23 and generally conform to its shape. Both body member 12 and arm members 22 define containers fabricated from a generally, water repellent, first foraminous material, such as as plastic filament screen or scrim material. Contained within body member 12 and arm members 22 is a second generally resilient, water repellent, second foraminous material 24 which is disposed throughout the interior of body member 12 and arm members 22 in a generally random manner or folded in the manner shown in FIG. 2 to allow the free flow of air and moisture throughout their interiors. It is important in selecting the resiliency or stiffness of second foraminous material 24 to provide a resiliency or stiffness sufficient to hold the sides of foraminous container or body member 12 and arm members 22 apart when a wet garment 23 is draped over them.

The material 14 from which bag or body member 12 is fabricated should have strength and be flexible but with rigidity or resilience. A woven material fabricated from a filament plastic such as nylon or polyester has been found to be satisfactory. A plastic coated wire or a plastic coated filament is also satisfactory. Depending upon the resilience of material 14 from which body member 12 is fabricated, an open weave fabric having $\frac{1}{4}$ inch openings can be used.

With reference to FIG. 3, a further embodiment of the garment drying device 10 of the present invention is illustrated in which an insert 60, fabricated from the same material 14, is sewn along the side of body member 12 to provide greater volume to member 12. A pair of Velcro® multiple hook and loop fasteners 62 are attached proximate the bottom inside of body member 12 to permit the insertion of additional foraminous material 24 inside body member 12.

Proximate the upper or neck end of body member 12 of garment drying device 10 is a support bar or member 30 having a shape approximating the shape of the shoulder or other part of the garment and having a hook 32 attached thereto for hanging device 10 in the vertical position. A pair of foam rubber or foam plastic pads 34 (FIG. 3) are arranged on top of support bar 30 to prevent seam and hanger marks from showing on the garment.

With reference to FIG. 4, for the situation in which the garment is shrinkable, a support frame 40 can be inserted in body member 12. Frame 40 basically comprises shoulder or top support member 42 which is connected to side support members 44 and 46 by adjustable connectors 48 and 50. Side support members 44 and 46 are connected to each other at the lower portion of frame 40 by adjustable connector 52. Thus side members 44 and 46 can be moved toward and away from each other depending upon the size of the garment being dried.

A support hook 54 is attached to shoulder or top support frame 42 for the purpose of hanging the device in the vertical position.

To use the garment drying device of FIG. 1, arm members 22 are pulled up through the arms of the damp garment or sweater 23 and are adjusted to prevent any bulges or folds, arm members 22 being adjusted to abut their seams 20 against seams 18 of body member 12. Then the damp garment or sweater 23 is draped over body member 12 or body member 12 is pulled up through and to the shoulder seam of sweater 23 and adjusted to eliminate folds and bulges. If frame 40 is utilized, it should be adjusted to the sweater size prior to draping or fitting garment 23 over body member 12.

Garment drying device 10 can then be hung up in the vertical position using hook member 32 (FIG. 1) or hook member 54 (FIG. 3).

It can be seen that when garment 23 is placed over garment drying device 10 of the present invention, air will be allowed to freely flow within the garment by natural convection to allow more rapid drying of the garment due to the doubling of the surface area inside and out when compared to prior art devices.

If desired, auxiliary warm air may be introduced proximate the bottom or lower end of body member 12, such as by a hair drier of the like to accelerate the drying process.

Thus is disclosed a garment drying device having superior garment drying characteristics.

I claim:

1. A garment drying form for insertion within a sweater having a shape and size within a predetermined range so as to hold said sweater open and thereby facilitate drying of said sweater from its inside as well as its outside, comprising:

a first sheet of a flexible, foraminous, open-weave mesh, water-repellent material shaped to provide a container which conforms generally to the interior of said sweater, a hanger positioned within a top portion of said container for suspending said container by the top end thereof, the rest of said container being free of stays and bones so that said container is able to flex, be resilient, and readily assume any shape or configuration within said predetermined range of shapes and sizes, a second sheet of flexible, foraminous, open-weave mesh, water-repellent material disposed in a generally random manner within and substantially filling said container so as to hold the walls of said container separated so that air can circulate within the interior of said container.

2. The sweater drying form of claim 1 further including a pair of arm portions, each comprising a sheet of a flexible, foraminous, open-weave mesh, water-repellent material which is shaped to conform generally to the respective sleeve portions of said sweater, each arm portion being free of stays and bones so that it is able to flex, be resilient, and readily assume the shape of the arm portion of said sweater.

* * * * *